US005291798A

United States Patent [19]

Tanigawa et al.

[11] Patent Number: 5,291,798

[45] Date of Patent: Mar. 8, 1994

[54] GEARED MOTOR FOR SELF-TRAVELLING CARRIER

[75] Inventors: Masayuki Tanigawa, Kariya; Tetsuo Takechi, Handa; Kiyoji Minegishi, Aichi, all of Japan

[73] Assignee: Sumitomo Heavy Industries, Ltd., Tokyo, Japan

[21] Appl. No.: 905,604

[22] Filed: Jun. 26, 1992

[30] Foreign Application Priority Data

Jun. 27, 1991 [JP] Japan ..... 3-183262

[51] Int. Cl.[5] ..... F16H 1/12

[52] U.S. Cl. ..... 74/421 A; 74/416

[58] Field of Search ..... 74/412 R, 416, 421 A, 74/606 R

[56] References Cited

U.S. PATENT DOCUMENTS 3,665,774 5/1972 Bauhus ..... 74/421 A

FOREIGN PATENT DOCUMENTS 882343 7/1953 Fed. Rep. of Germany ... 74/421 A
886994 8/1953 Fed. Rep. of Germany ... 74/421 A
3819977 7/1989 Fed. Rep. of Germany .
250536 8/1930 Italy ..... 74/421 A
2018698 10/1979 United Kingdom .
2160836 1/1986 United Kingdom .

*Primary Examiner*—Rodney H. Bonck
*Assistant Examiner*—David W. Laub
*Attorney, Agent, or Firm*—Nikaido Marmelstein Murray & Oram

[57] ABSTRACT

In a geared motor for a self-traveling carrier, a projected area in an advancing direction of the carrier is made small to reduce the space required around a track. Despite the fact that the geared motor being is a single type of a geared motor (the same geared motor), it is possible to select a suitable mounting mode from among various mounting modes, thus permitting a smoother operation of a physical distribution system as a whole. For example, in a geared motor for a self-traveling carrier, a reduction mechanism housed in a gear box incorporates an output shaft with a wheel mounted thereon, an output shaft gear, an intermediate shaft disposed in parallel with the output shaft, an intermediate pinion and a hypoid gear both mounted on the intermediate shaft, and a hypoid pinion mounted on a motor shaft. The motor shaft is disposed between the intermediate shaft and the output shaft orthogonally thereto. Further, three faces of the gear box are used as mounting faces for mounting the geared motor to the carrier.

5 Claims, 7 Drawing Sheets

GEARED MOTOR FOR SELF-TRAVELLING CARRIER

BACKGROUND OF THE INVENTION

1. Field of the Invention

The present invention relates to a geared motor for a self-traveling carrier wherein a motor for driving a wheel of the self-traveling carrier adapted to travel through the rolling of the wheel on a track, and a gear box housing therein a speed change mechanism disposed between a motor shaft of the motor and the wheel, are rendered integral with each other.

2. Description of the Prior Art

In Japanese Utility Model Laid Open No. 55166/89 there is disclosed a self-traveling carrier of a conveyor for use in a physical distribution system. This self-traveling carrier, as shown in FIG. 7, is provided with a driving trolley 11 and a driven trolley 12 both capable of moving along a traveling rail (track) 2 and disposed of intervals from each other in the longitudinal direction, a connecting member 13 for connecting both trolleys 11 and 12, and a goods table 15 mounted to the connecting member 13 through a pair of front and rear hangers 14.

As shown in FIG. 8, the driving trolley 11 is provided with a driving roller (wheel) 16 adapted to roll on an upper surface of an upper flange of the traveling rail 2, four guide rollers 17 disposed on both sides of the upper flange of the rail 2 and of a lower flange of the rail, an electric motor 18 for rotating the driving roller 16, a reduction mechanism 19 with a clutch device disposed between the driving roller 16 and the electric motor 18, and a gear box 50 which houses therein the reduction mechanism 19 with a clutch device.

According to the construction of the reduction mechanism 19, power is transmitted to an output shaft 23 through a pinion 30 mounted on a motor shaft 29, a gear 34 meshing with the pinion 30, a bevel pinion 35 formed integrally with an intermediate shaft 33 onto which is fixed the gear 34, and further through a bevel gear 28 meshing with the bevel pinion 35.

Though not shown, there is also provided a current collector adapted to slide on a current collector rail 3.

Upon rotation of the motor 18, the driving roller 16 rotates through the reduction mechanism 19 with a clutch device, so that the driving trolley 11 travels on the traveling rail 12. Consequently, the driven trolley 12 connected to the driving trolley through the connecting member 13 also travels on the rail 2, whereby the goods table 15 mounted to the connecting member 13 through the hangers 14 can be moved.

Further, even in the event of occurrence of trouble or the like, the self-traveling carrier can be easily moved manually because the mechanical connection between the motor shaft 29 and the driving roller 16 can be released by the function of the clutch device.

In such a conventional self-traveling carrier, however, there have been the following problems associated with its geared motor portion (the portion including both the motor and the gear box).

a: Since there is adopted a structure wherein the motor 18 is suspended vertically on the side of output shaft 23 projecting in the direction opposite to the driving roller 16 with respect to a bearing portion (indicated at numerals 21 and 22 in FIG. 8) which bears the wheel load, a projected area of the geared motor in the advancing direction of the carrier 1 corresponds to an "axial sectional area" of the geared motor and thus it is very large.

More particularly, from the nature of the carrier which travels on the track, it is necessary that an "obstacle-free space" larger than the projected area in the advancing direction of the carrier is ensured around the track and throughout the whole section of the track. Therefore, if the projected area in the carrier advancing direction of the geared motor is large, the mounting of the self-traveling carrier itself may be impossible, or it will be impossible to utilize the space around the track effectively for other purposes.

b: The reduction mechanism portion comprises such conventional combinations as the pinion 30—gear 34 and the bevel pinion 35—bevel gear 28, also, the projection of the clutch device portion is fairly large, so the reduction in size of the gear box into a compact size is not attained, and the projected area itself of the gear box is also large.

c: The mounting of the geared motor to the carrier is exclusively for the self-traveling carrier, so with one type of a gear box, it is impossible to cope with various mounting methods.

This point will now be explained more concretely. In a physical distribution system or the like comprising a plurality of self-traveling carriers for example, it is efficient to operate of the system a necessary portion only when required. In driving the self-traveling carriers, it is more convenient for each self-traveling carrier to be independent. Also, it is often necessary to change the position of each self-traveling carrier for changing a conveyance path. Also, in such cases, it is more convenient for each self-traveling carrier to be independent.

For this reason, as in the above conventional example, a self-traveling carrier with a "motor," more exactly a self-traveling carrier with a "geared motor" comprising a motor and a speed change mechanism (generally a reduction mechanism), has become popular. Therefore, in this case, when viewed from the entire self-traveling carrier, the "geared motor" merely constitutes a portion of the carrier. Also as to each self-traveling carrier, it merely constitutes a portion of the physical distribution system when viewed from the whole of the system.

In relation to the entire physical distribution system, therefore, various members which are obstacles to the mounting of the geared motor are often present around the self-traveling carriers. Further, with respect to a self-traveling carrier which is already in use, in the case where a certain member is newly present within a projected area in the advancing direction of that carrier, it sometimes becomes impossible for the geared motor portion of the carrier to remain mounted as it is.

In such a case, the foregoing prior art permits only "one face" to effect mounting of the geared motor portion of the self-traveling carrier and hence it is impossible to effect various modes of mounting correspondingly to the positions of other devices and members.

Generally, in such a case, it is necessary to beforehand provide various geared motors different in the mounting face and mounting method and to select a suitable geared motor according to conditions. As the entire physical distribution system, however, it is not desirable to provide a variety of geared motors, from the standpoint of maintenance and control of the system.

SUMMARY OF THE INVENTION

The present invention has been accomplished in view of the conventional problems mentioned above and it is the object of the present invention to provide, for overcoming such problems. A geared motor for a self-traveling carrier wherein a projected area in a carrier advancing direction of the geared motor is small and which, despite of being a single type of a geared motor (that is, while facilitating the maintenance and control of the physical distribution system and suppressing the increase of the entire cost), permits an optional selection of a suitable mounting method from among various mounting methods according to different conditions.

Accordingly, in order to solve the foregoing problems, the present invention is directed to a geared motor for a self-traveling carrier wherein a motor for driving a wheel of the self-traveling carrier adapted to travel through rolling of the wheel on a track, and a gear box housing therein a speed change mechanism disposed between a motor shaft of the motor and the wheel, are rendered integral with each other. The speed change mechanism in the gear box comprises an output shaft with the wheel mounted thereto, an output shaft gear fixed onto the output shaft, an intermediate shaft disposed in parallel with the output shaft, an intermediate pinion mounted on the intermediate shaft and capable of meshing with the output shaft gear, a hypoid gear fixed onto the intermediate shaft, and a hypoid pinion formed integrally with the motor shaft and meshing with the hypoid gear, wherein the motor shaft is disposed orthogonally between the intermediate shaft and the output shaft.

If the intermediate pinion is made axially slidable, in a splined state on the intermediate shaft and if the splined state can be released by sliding motion, it becomes possible to easily release the mechanical connection between the wheel and the driving motor. Thus, the self-traveling carrier can be easily moved manually, for example, in the event of any trouble.

If the gear box is formed generally in the shape of a rectangular parallelopiped, and if an output shaft projecting face thereof, a face thereof parallel to the output shaft and spaced at a short distance from the output shaft and at a long distance from the motor shaft, and a face thereof parallel to the output shaft and spaced at a long distance from the output shaft and at a short distance from the motor shaft, are formed beforehand as faces capable of being mounted to the carrier, this geared motor, despite being a single type of a geared motor (the same geared motor), can be mounted to the self-traveling carrier in various mounting modes in relation to the surrounding devices and members.

In the first aspect of a present invention, since the output shaft gear and the hypoid gear, which occupy a large volume, are disposed in parallel with each other, the speed change mechanism (reduction mechanism) can be made very compact in comparison with the prior art wherein the bevel gear 28 and the gear 34 are arranged in series vertically. Hence, it is possible to reduce the size of the gear box which houses the speed change mechanism therein.

Moreover, since the combination of a hypoid gear and a hypoid pinion is adopted as a gear element for changing the rotation of the motor shaft to an orthogonal direction, the size in the motor shaft direction or in the direction orthogonal to the motor shaft can be reduced by an amount corresponding to the offset in comparison with the conventional combination of the bevel pinion 35 and the bevel gear 28.

Further, since the motor shaft can be disposed in parallel with the carrier advancing direction, the projected area in the carrier advancing direction can be made much smaller than in the prior art. Hence, the space around the track can be utilized more effectively.

In a second aspect of the present invention, in addition to the above construction, since an intermediate pinion is made axially slidable in a splined state on the intermediate shaft and the splined state can be released by the sliding motion, the addition of a clutch function is realized in a very compact and simple construction as compared with the prior art.

In a third aspect of the present invention, since the gear box is generally formed in the shape of a rectangular parallelopiped, three faces of the gear box can be used as faces different in distance, etc. with respect to the output shaft (faces different in mounting mode). Therefore, since these three faces of different characters are formed beforehand as faces capable of being mounted to the carrier, coupled with the adoption of the hypoid gear and the hypoid pinion, it becomes possible to mount the geared motor to the carrier in various mounting modes according to the surrounding conditions.

Thus, according to the present invention, since the projected area of the geared motor in the advancing direction of the carrier can be reduced, it is possible to make the necessary space around the track smaller, and hence the space around the carrier can be utilized more effectively.

Further, since three faces of different characters can be used as mounting faces, a mounting face advantageous to the entire system can be selected (in the same geared motor) in view of the relation to other carriers, as well as the space of the entire physical distribution system and obstacles.

BRIEF DESCRIPTION OF THE DRAWINGS

The above and other objects, features and advantages of the present invention will become more apparent from the following description of the invention taken in conjunction with the accompanying drawings, wherein like reference characters designate the same or similar parts, and wherein.

DETAILED DESCRIPTION OF THE PREFERRED EMBODIMENT

An embodiment of the present invention will be described in detail hereinunder with reference to the accompanying drawings.

Figure 1:
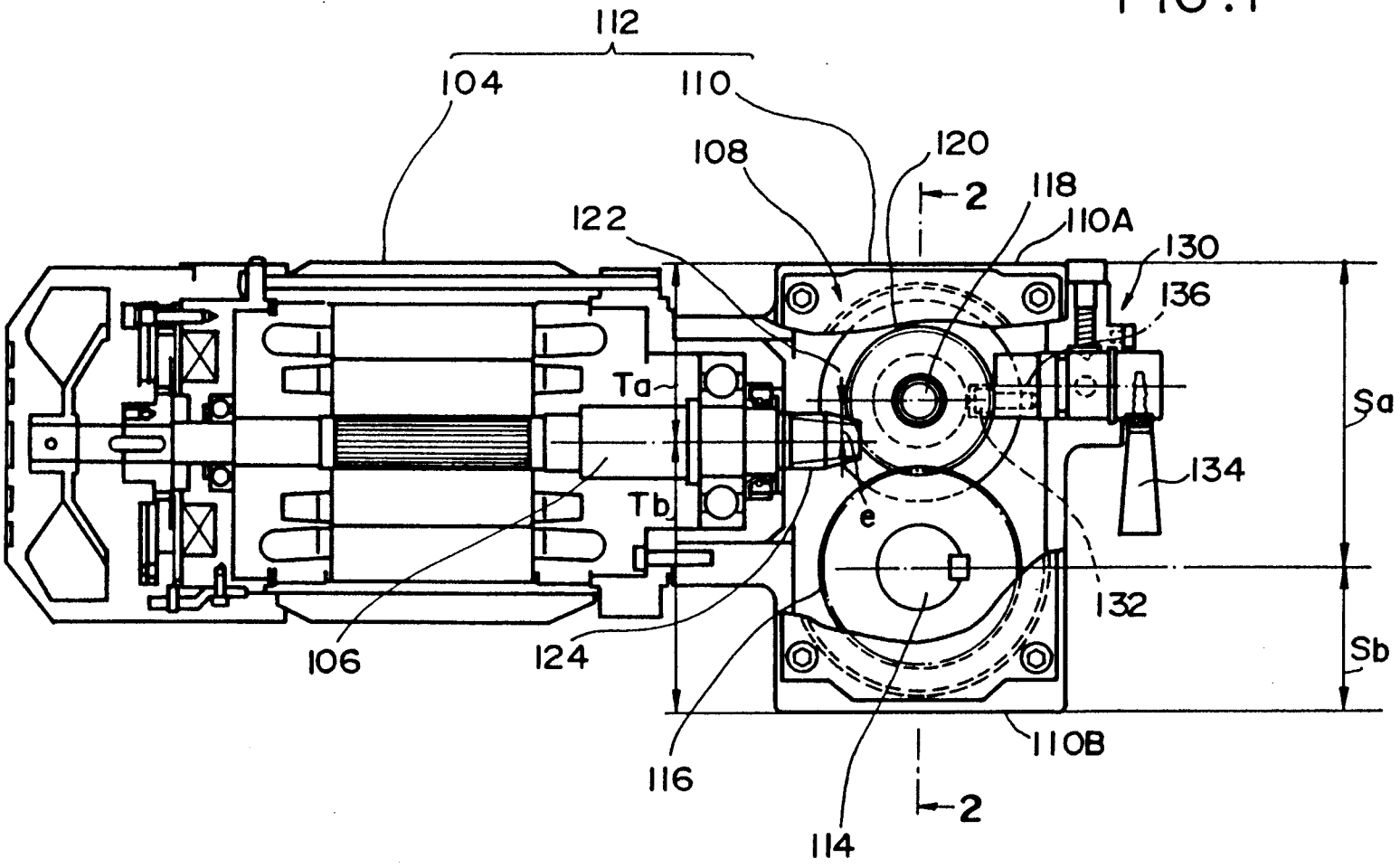
FIG. 1 is a sectional view showing a geared motor for a self-traveling carrier according to an embodiment of the present invention.
Figure 2:
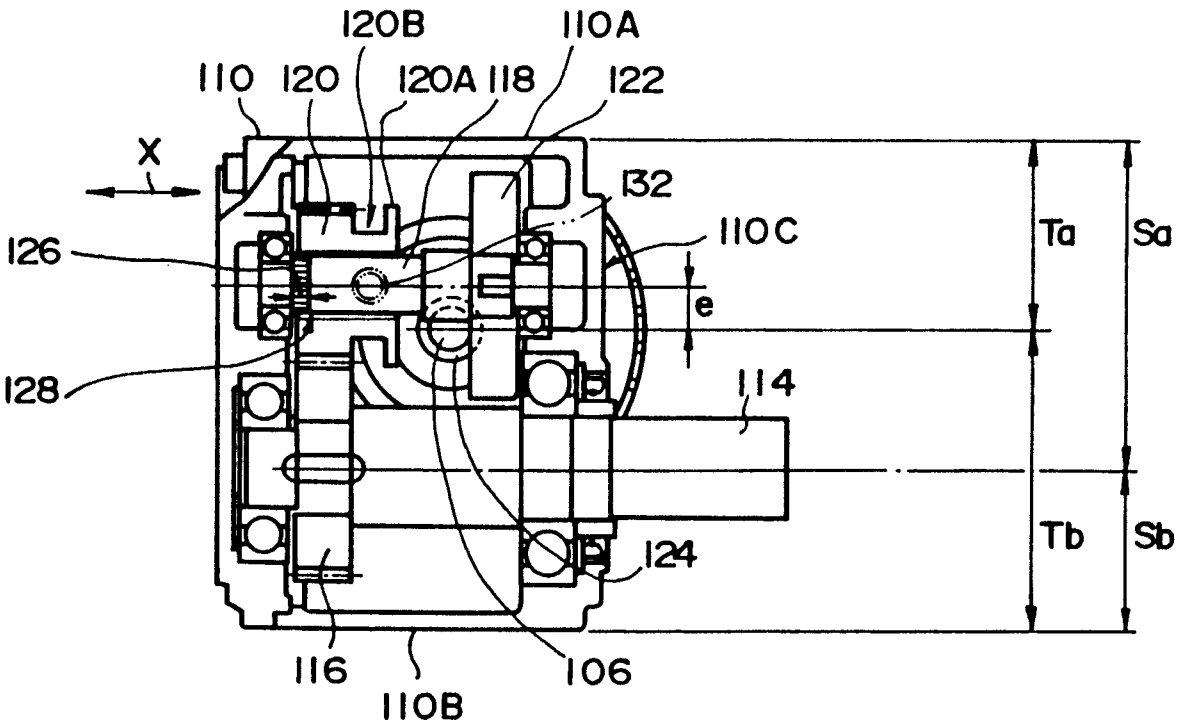
FIG. 2 is a sectional view taken along arrowed line 2—2 in FIG. 1.
Figure 3:
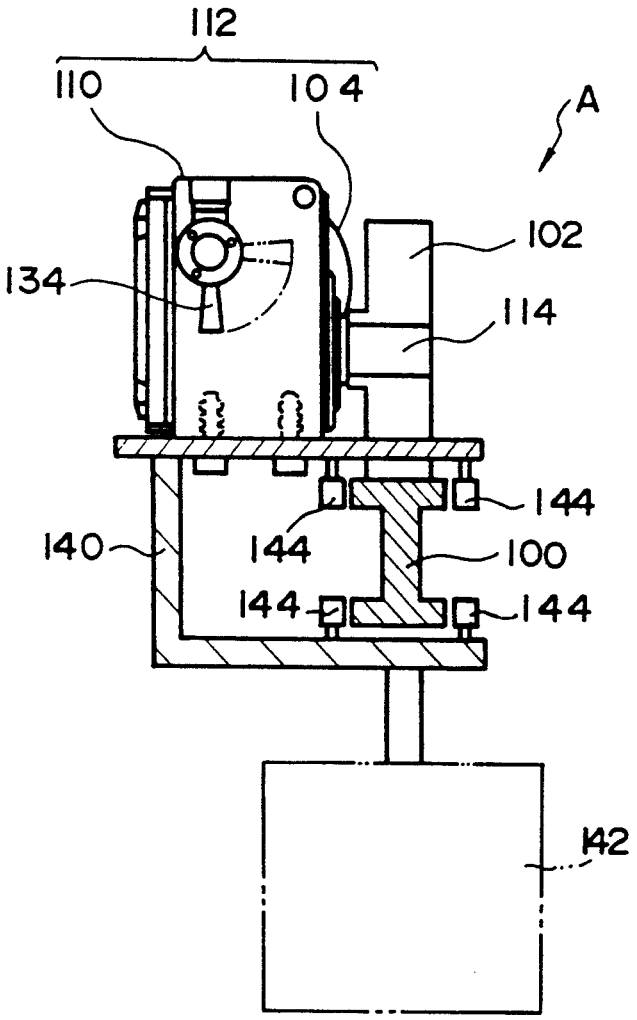
FIG. 3 is a schematic front view in which the geared motor is applied to a self-traveling carrier of a carrier self-traveling type conveyor.

The embodiment, as shown incorporates FIGS. 1 to 3, in a geared motor 112 for a self-traveling carrier wherein a motor 104 for driving a wheel 102 of the self-traveling carrier A adapted to travel through rolling of the wheel 102 on a rail (track) 100, and a gear box 110 housing therein a reduction mechanism (a speed change mechanism) 108 disposed between a motor shaft 106 of the motor 104 and the wheel 102, are rendered integral with each other. The reduction mechanism 108 in the gear box 110 comprises an output shaft 114 with the wheel 102 mounted thereon, an output shaft gear 116 fixed onto the output shaft 114, an intermediate shaft 118 disposed in parallel with the output shaft 114, an intermediate pinion 120 mounted on the intermediate shaft 118 and capable of meshing with the output shaft gear 116, a hypoid gear 122 fixed onto the intermediate shaft 118, and a hypoid pinion 124 formed integrally with the motor shaft 106 and meshing with the hypoid gear 122. The motor shaft 106 is disposed between the intermediate shaft 118 and the output shaft 114 orthogonally to these shafts.

As to the intermediate shaft 118, only the portion indicated by the reference numeral 126 is splined, while as to the intermediate pinion 120, only the portion indicated by the reference numeral 128 is splined.

The intermediate pinion 120 has a flange portion 120A, which defines a concave portion 120B, and a projecting portion 132 of a clutch device 130 is fitted in the concave portion 120B. The projecting portion 132 can be moved pivotally about a central line 136 by rotating a handle 134 of the clutch device 130 90° from a vertically downward position up to a horizontal position. A component of this pivotal motion acting in the intermediate shaft direction permits the intermediate pinion 120 to slide in the direction of arrow X on the intermediate shaft 118. As a result of this sliding motion, the splined engagement of the intermediate pinion 120 and the intermediate shaft 118 is released (disengaged), so that even when the intermediate pinion 120 rotates, this rotation is not transmitted to the intermediate shaft 118.

Although the hypoid gear 122 and the output shaft gear 116 each requires a large mounting capacity, since both are disposed in parallel with each other, it is possible to make the gear box 110 more compact than in the prior art in which they are disposed in series vertically.

The gear box 110 is formed generally in the shape of a rectangular parallelopiped as a whole, and the following three faces thereof can be used as mounting faces:

(1) a flange face 110C from which the output shaft 114 is projecting;

(2) an under face 110B parallel to the output shaft 114 and having a small projecting size Sb from the output shaft and a large projecting size Tb from the motor shaft 106; and (3) an upper face 110A parallel to the output shaft 114 and having a large projecting size Sa from the output shaft 114 and a small projecting size Ta from the motor shaft 106.

Therefore, a suitable mounting face can be selected as necessary from those mounting faces and it is possible to effect mounting in various modes according to conditions.

In FIG. 3, the reference numerals 140, 142 and 144 represent a frame, goods to be conveyed, and a guide roller, respectively.

Figure 4:
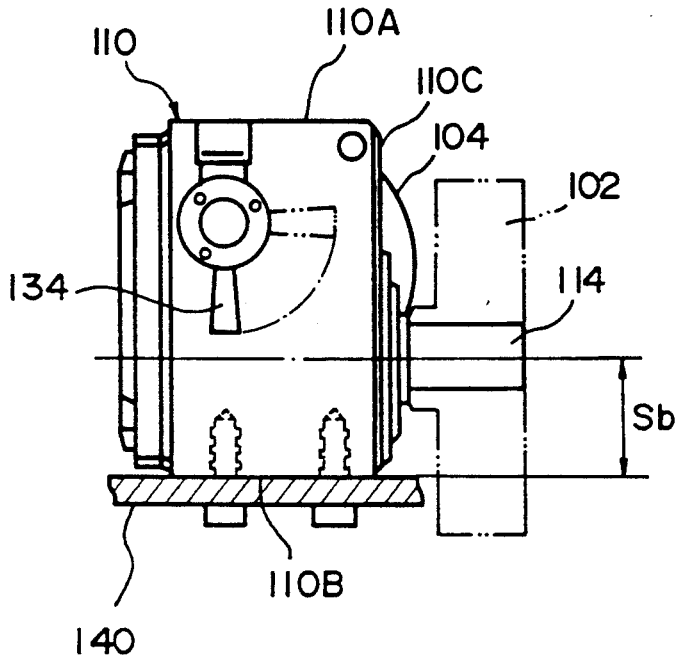
FIG. 4 is a front view showing an example in which the geared motor is mounted using an under face of a gear box.
Figure 5:
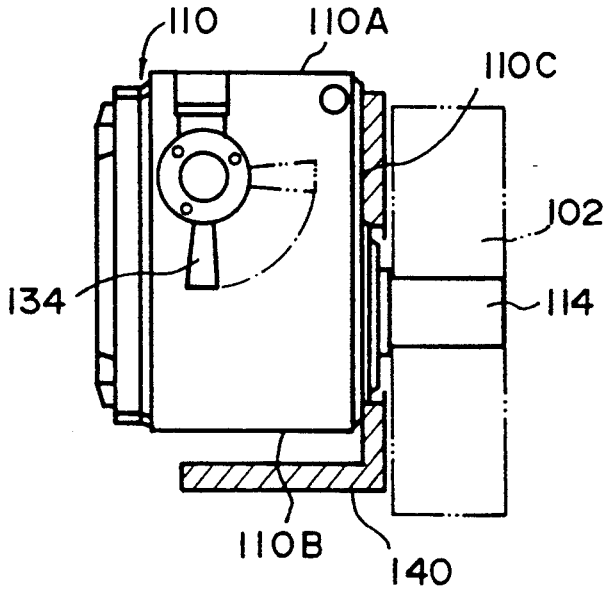
FIG. 5 is a front view showing an example in which the geared motor is mounted using a flange face of the gear box.
Figure 6:
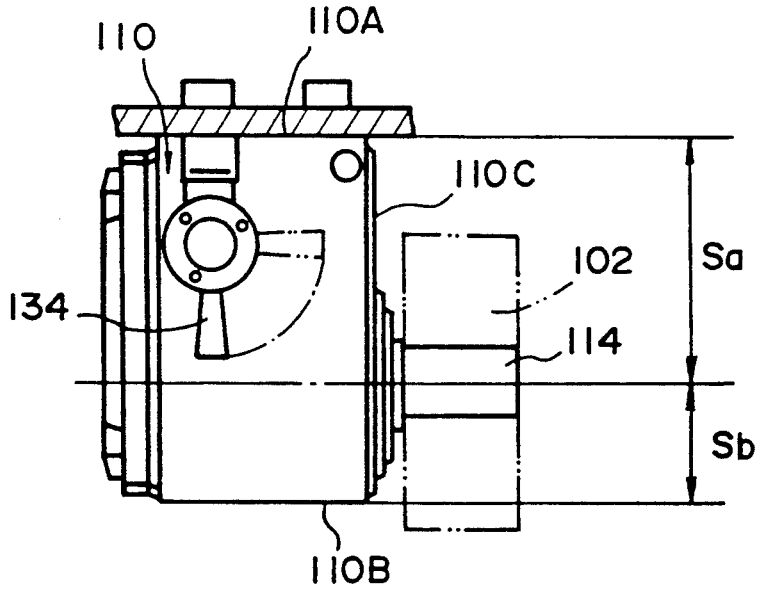
FIG. 6 is a front view showing an example in which the geared motor is mounted using an upper face of the gear box.
Figure 7:
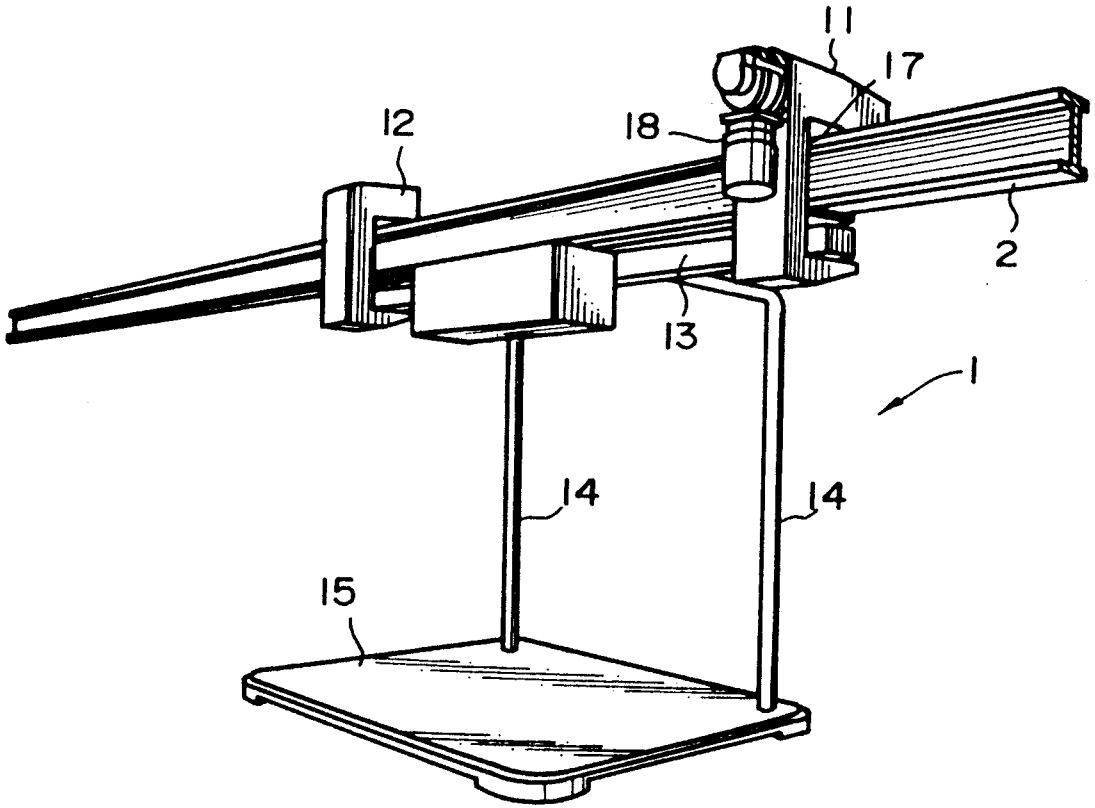
FIG. 7 PRIOR ART
FIG. 7 is a schematic perspective view showing an example in which a conventional self-traveling carrier is applied to a conveyor.
Figure 8:
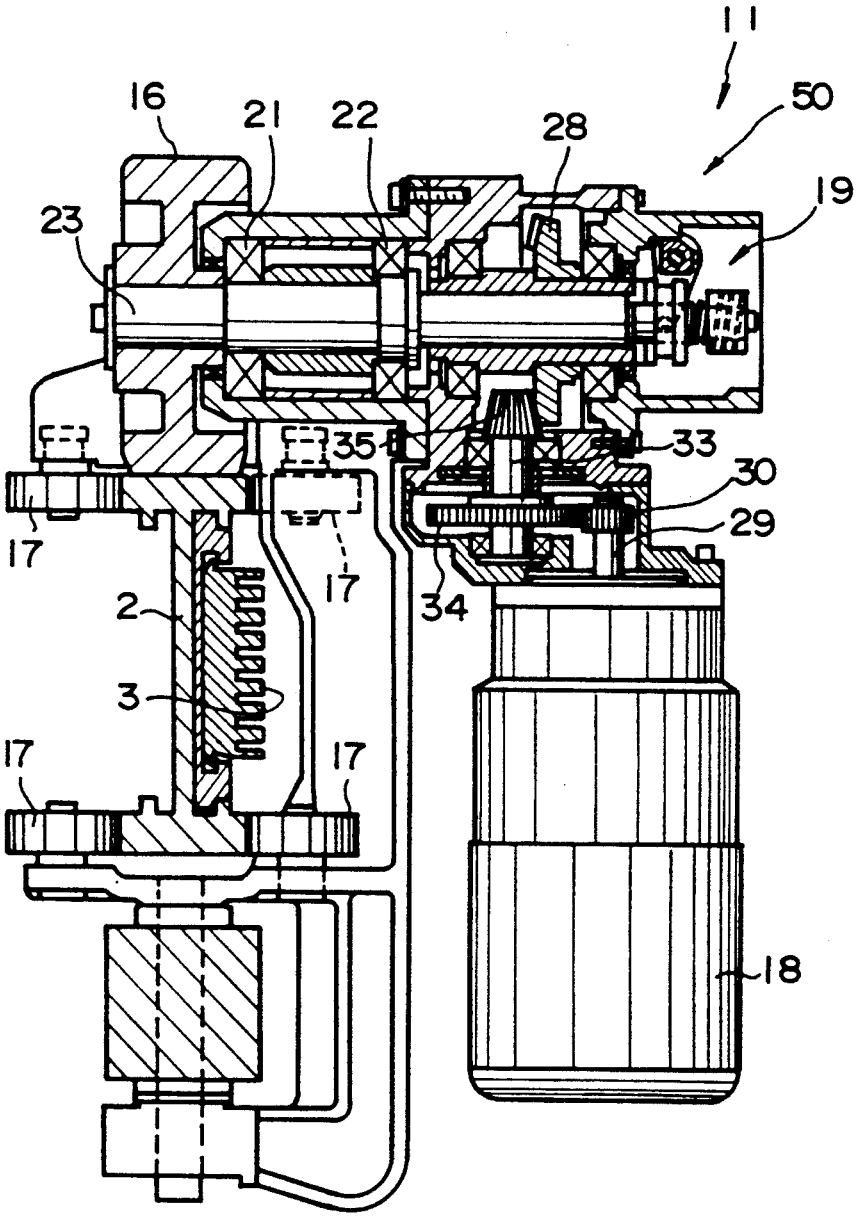
FIG. 8 PRIOR ART
FIG. 8 is an enlarged sectional view of a geared motor portion in the above conventional example.

Referring now to FIGS. 4 to 6, there are shown mounting examples of the geared motor 112. In the example shown in FIG. 4, the under face 110B is used as a mounting face. According to this mounting method, it is possible to use a wheel of a small diameter because the amount of projection Sb from the center of the output shaft 114 is small. This mounting method is convenient when the space above the carrier is limited, because nothing is present above the upper face 110A.

In the example shown in FIG. 5, the output shaft projecting face (flange face) 110C is used as a mounting face. This mounting method is applicable conveniently to a carrier for heavy goods because the geared motor 112 can be mounted firmly to a frame 140 of the self-traveling carrier by the use of a spigot joint and bolts.

In the example shown in FIG. 6, the upper face 110A of the gear box 110 is used as a mounting face. According to this mounting method, since the amount of projection Sb from the output shaft 114 to the under face 110B is small, it is possible to use a wheel of a small diameter, and since the amount of projection Sa up to the upper face 110A is large, a wheel of a large diameter can be accommodated in the space defined by the mounting face where required. Further, this mounting method is convenient in the case where it is desired to ensure a lower space of the carrier as large as possible.

Anyhow, a maximum size of the geared motor 112 resides in the axial direction of the motor 104 (because the motor is long axially), but since the motor 104 is parallel to the wheel 102 and also parallel to the advancing direction of the carrier, the projected area in the carrier advancing direction is actually very small to the extent of being covered within the projected area of the gear box 10.

Moreover, since the element for changing the rotating direction of the motor 104 to an orthogonal direction is constituted by the hypoid gear 122 and the hypoid pinion 124, the size in the direction orthogonal to the motor (the direction influencing the projected area) can be reduced by an amount corresponding to the offset "e" (FIGS. 1 and 2).

Further, the output shaft gear 116 and the hypoid gear 122 are disposed in parallel with each other, so also in this point it is possible to realize a compact structure of the gear box 110 itself.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. A geared motor for a self-traveling carrier wherein a motor for driving a wheel of said self-traveling carrier which travels by rolling said wheel on a track, and a gear box housing a speed change mechanism which is disposed between a motor shaft of said motor and said wheel are integrated, characterized in that said speed change mechanism in said gear box comprises an output shaft with said wheel mounted thereon, an output shaft gear fixed onto said output shaft, an intermediate shaft disposed in parallel with said output shaft, an intermediate pinion mounted on said intermediate shaft and capable of meshing with said output shaft gear, a hypoid gear fixed onto said intermediate shaft, and a hypoid pinion integrally formed with said motor shaft and meshing with said hypoid gear, wherein said motor shaft is disposed between said intermediate shaft and said output shaft orthogonally thereto, and said intermediate pinion is axially slidable in a splined state on said intermediate shaft, and said splined state can be released by said sliding motion.

2. A geared motor for a self-traveling carrier according to claim 1, wherein said gear box is formed generally in the shape of a rectangular parallelopiped so as to have the following faces as faces capable of being mounted to the carrier:

a face from which said output shaft is projecting;

a face parallel to said output shaft and spaced at a short distance from the output shaft and at a long distance from said motor shaft; and a face parallel to said output shaft and spaced at a long distance from the output shaft and at a short distance from said motor shaft.

3. A geared motor structure for a self-traveling carrier operatively mounted on a track, comprising:

a wheel operatively mounted to roll on the track;

a motor having a motor shaft and operatively connected to drive said wheel;

a speed change mechanism including an output shaft mounted onto said wheel, an output shaft gear fixed onto said output shaft, an intermediate shaft located parallel to the output shaft, an intermediate pinion mounted on the intermediate shaft and operatively engaged with the output shaft gear, a hypoid gear fixed onto the intermediate shaft, and a hypoid pinion integrally formed with the motor shaft and operatively engaged with the hypoid gear, wherein the motor shaft of said motor is orthogonally positioned relative to said speed change mechanism between the intermediate shaft and the output shaft; and a gear box housing located between the motor shaft of said motor and said wheel, said gear box being formed so as to house said speed change mechanism, wherein the intermediate pinion and the intermediate shaft are splined so as to be inter-engaged with each other, the intermediate pinion further being axially slidable along the intermediate shaft so as to be slidably releasable from the intermediate shaft.

4. A geared motor for a self-traveling carrier according to claim 3, wherein said gear box is formed generally in the shape of a rectangular parallelopiped so as to include means for selectively mounting the geared motor with the carrier through at least one of a first face of said gear box from which the output shaft is projecting, a second face of said gear box parallel to the output shaft and spaced at a short distance from the output shaft and at a long distance from the motor shaft, and a third face of said gear box parallel to the output shaft and spaced at a long distance from the output shaft and at a short distance from said motor shaft.

5. A speed change mechanism for a geared motor structure in a self-traveling carrier operatively mounted on a track, wherein the motor structure includes a wheel operatively mounted to roll on the track, a motor having a motor shaft and operatively connected to drive the wheel, and a gear box housing located between the motor shaft of the motor and the wheel, the gear box being formed so as to house the speed change mechanism, the speed change mechanism comprising:

an output shaft mounted onto the wheel;

an output shaft gear fixed onto said output shaft;

an intermediate shaft located parallel to said output shaft;

an intermediate pinion mounted on said intermediate shaft and operatively engaged with said output shaft gear;

a hypoid gear fixed onto said intermediate shaft; and a hypoid pinion connected to the motor shaft and operatively engaged with said hypoid gear, wherein the motor shaft of the motor is orthogonally positioned relative to the speed change mechanism between said intermediate shaft and said output shaft, and said intermediate pinion and said intermediate shaft are splined so as to be inter-engaged with each other, said intermediate pinion further being axially slidable along said intermediate shaft so as to be slidably releasable from said intermediate shaft.

* * * * *